US006619495B1

(12) United States Patent
Parés Montaner et al.

(10) Patent No.: US 6,619,495 B1
(45) Date of Patent: Sep. 16, 2003

(54) BOTTLE CLOSING DEVICE

(75) Inventors: Pere Parés Montaner, Esplugues de Llobregat (ES); Victor Ribera Turró, Barcelona (ES)

(73) Assignee: Saint-Gobain Calmar, S.A., Barcelona (ES)

( * ) Notice: Subject to any disclaimer, the term of this patent is extended or adjusted under 35 U.S.C. 154(b) by 0 days.

(21) Appl. No.: 09/914,073

(22) PCT Filed: Mar. 17, 2000

(86) PCT No.: PCT/ES00/00091

§ 371 (c)(1),
(2), (4) Date: Aug. 22, 2001

(87) PCT Pub. No.: WO00/56617

PCT Pub. Date: Sep. 28, 2000

(30) Foreign Application Priority Data

Mar. 23, 1999 (ES) ..... 9900578
Mar. 8, 2000 (ES) ..... 200000557

(51) Int. Cl.[7] ..... B65D 45/32

(52) U.S. Cl. ..... 215/272; 215/274; 215/280; 222/153.11

(58) Field of Search ..... 215/272, 274, 215/280; 220/319; 222/153.01, 153.04, 321.7, 321.9, 385, 153.09, 153.11, 570

(56) References Cited

U.S. PATENT DOCUMENTS

| | | | | | |
|---|---|---|---|---|---|
| 2,045,480 | A | * | 6/1936 | Magnesen et al. | 215/272 |
| 3,893,582 | A | * | 7/1975 | Kowalik | 215/274 |
| 3,977,557 | A | * | 8/1976 | Hazard | 215/274 |
| 4,279,353 | A | * | 7/1981 | Honma | 215/272 |
| 4,565,302 | A | * | 1/1986 | Pfeiffer et al. | 222/321.9 |
| 4,773,553 | A | * | 9/1988 | Van Brocklin | 215/272 |
| 4,984,702 | A | * | 1/1991 | Pierpont | 215/272 |
| 5,562,219 | A | * | 10/1996 | de Pous et al. | 215/274 |
| 5,615,788 | A | * | 4/1997 | Larguia | 215/274 |
| 5,941,428 | A | * | 8/1999 | Behar et al. | 222/385 |

FOREIGN PATENT DOCUMENTS

WO WO 88/02297 * 4/1988

* cited by examiner

*Primary Examiner*—Robin A. Hylton
(74) *Attorney, Agent, or Firm*—Staas & Halsey LLP

(57) ABSTRACT

Device for closing bottles having a neck with an outer annular edge and including: a) a main body comprising an annular part having an outer edge area and tongues jointed to the outer edge area of the annular part, in addition to an inner surface, and outer surface, lateral surfaces and a lower surface in which the tongues have two first ribs standing out form the inner surface and adjacent to the lateral surfaces and the outer surface has a raised area and b) a sleeve with a substantially hollow and cylindrical part, wherein the substantially cylindrical part can be placed on the tongues.

14 Claims, 9 Drawing Sheets

FIG. 1
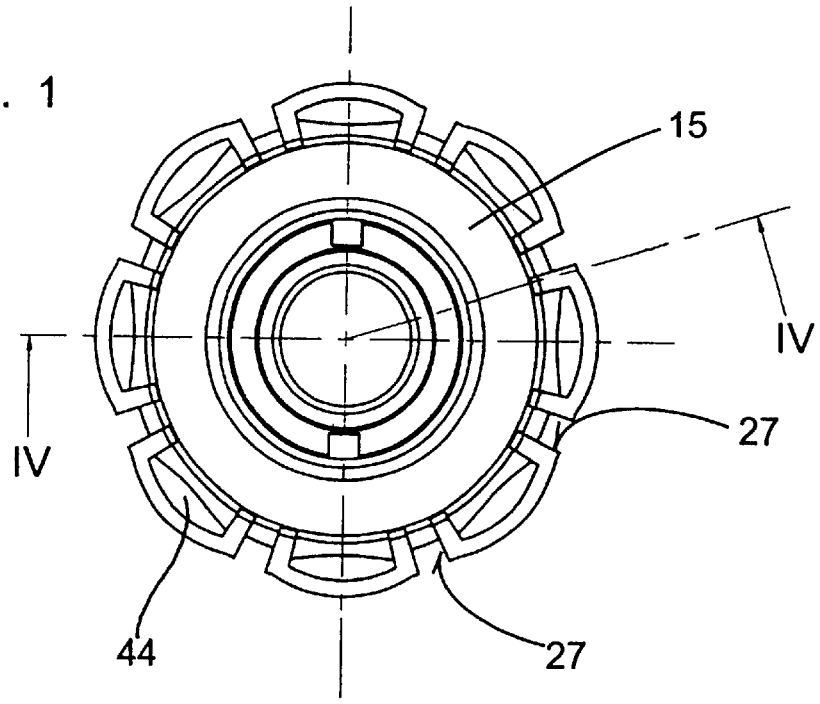
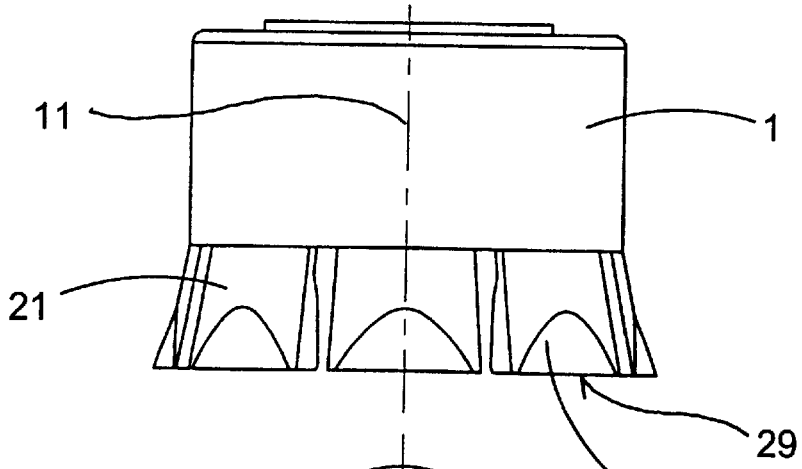
FIG. 2
FIG. 3
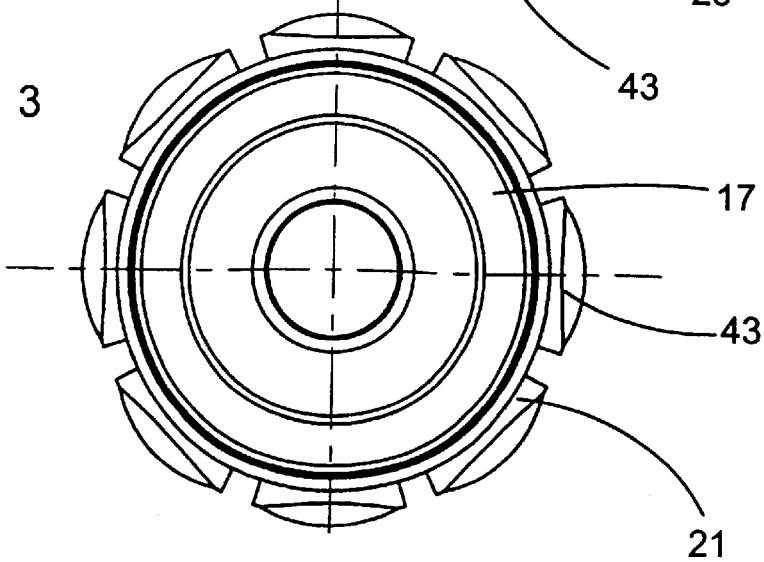

FIG. 12
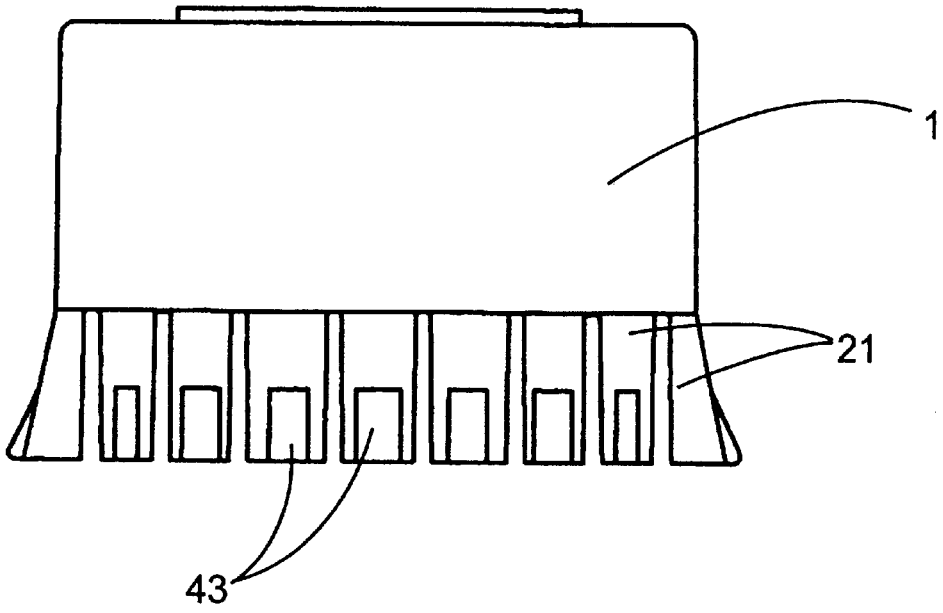
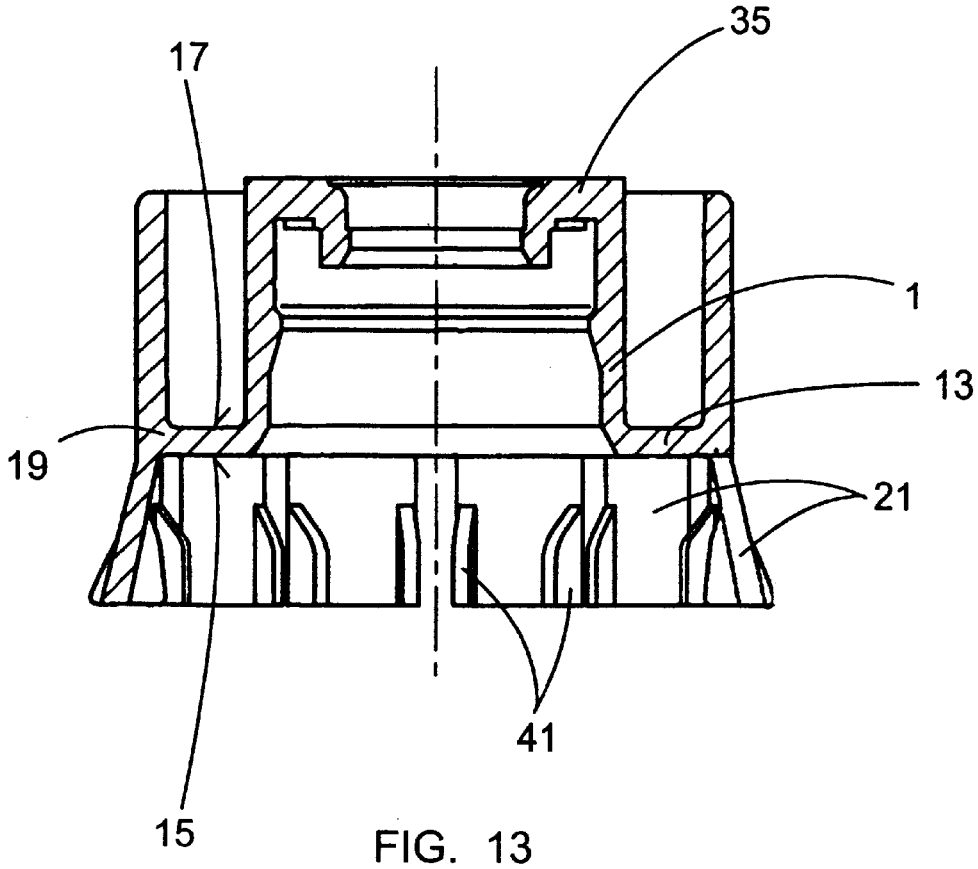
FIG. 13

FIG. 18
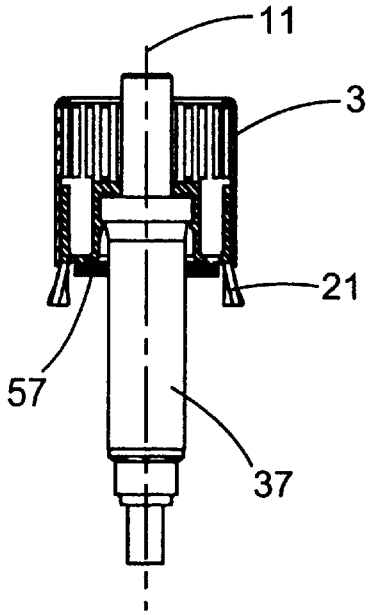
FIG. 19
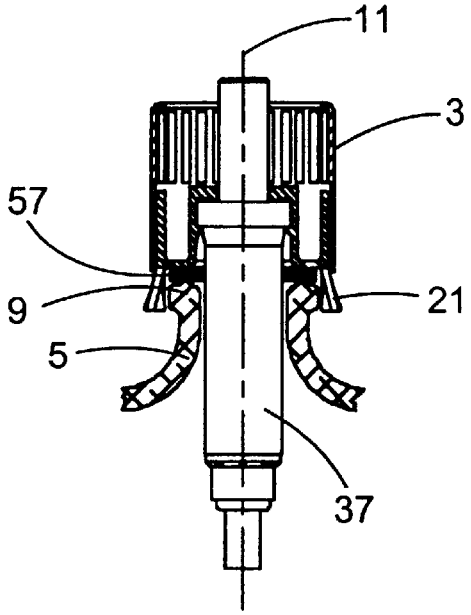
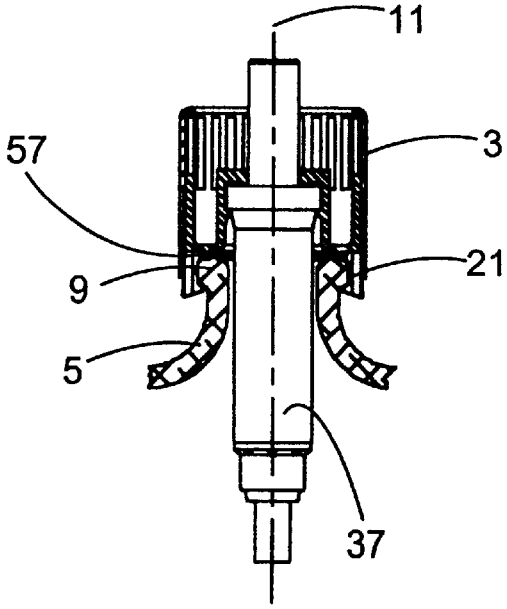
FIG. 20
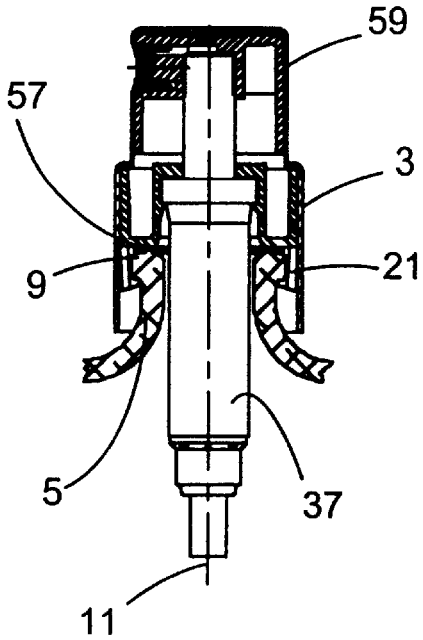
FIG. 21

BOTTLE CLOSING DEVICE

BACKGROUND OF THE INVENTION

1. Field of the Invention

The invention relates to a device for stopping bottles, of the type having a neck with an outer annular rim, with the neck defining a longitudinal axis and an upper edge, the device being adapted to take on a mounted position on the neck and with the device comprising: [a] a main body, which comprises an annular portion, generally parallel to the upper edge in the mounted position, with the annular portion having an outer edge region and tabs which are attached to the outer edge region of the annular portion and which are provided with an inner surface, close to the neck in the mounted position, an outer surface, opposite to the inner surface, lateral surfaces and a lower surface, and [b] a sleeve member, with a hollow substantially cylindrical portion, with the substantially cylindrical portion being adapted to be placed over the tabs.

2. Background Art

Bottle stoppers are known which operate by means of a ferrule of metallic material. They are used for stopping all kinds of bottles or flasks which have a neck with an outer annular rim on the upper edge of the neck. The outer annular rim usually has the upper portion thereof flat and flush with the upper edge of the bottle and the lower portion thereof is joined to the outer side surface of the neck at an intermediate point thereof. The ferrule is a metal part which is usually provided with a flat annular portion, and a cylindrical portion attached to the flat annular portion at the outer end thereof and perpendicular to said flat annular portion. When the ferrule is mounted on the bottle or flask, the flat annular portion bears against the outer annular rim, or on a resilient ring, the purpose of which is to improve the tightness of the closure and which is placed, in this case, on the outer annular rim. The flat annular portion is, in any case, generally parallel to the upper end of the outer annular rim. The cylindrical portion, then, externally surrounds the outer annular rim. Thereafter, it is necessary to carry out an operation which tightens said cylindrical portion against the outer annular rim, deforming it and there by attaching the ferrule to the bottle.

This process has a number of drawbacks, one of which is the cost thereof, both for the materials used and for the operations required for stopping a bottle.

There are, likewise, devices for stopping bottles made from plastics material which comprise an annular portion which is to be mounted parallel to the upper edge of the neck, tabs which extend downwardly from the outer edge of the annular portion and a generally cylindrical sleeve member adapted to slide over the tabs. Each tab has a protuberance which is positioned just under the outer annular rim when the sleeve member is placed over the tabs.

Nevertheless there is an additional difficulty where glass bottles are concerned and it is that they suffer from very great variations of the geometrical measurements thereof (diameter and ovalness of the outer annular rim, diameter and ovalness of the neck, concentricity of the neck and the outer annular rim, width and height of the outer annular rim, the upper and lower surfaces of the outer annular rim being out of parallel, etc.), whereby there is required a device which, apart from being cheap, has to be capable of absorbing the variations in the bottle to be stopped at the same time, nevertheless, as it maintains the pressure exerted against the sealing ring or resilient element constant.

SUMMARY OF THE INVENTION

In the present description and claims, the term bottle has been used to designate any container having a neck with an outer annular rim.

It is an object of the present invention to provide a device for stopping bottles of the type first mentioned above, wherein each of the tabs is provided with two first protuberances, extending from the inner surface and which are adjacent the lateral surfaces and in that the outer surface is provided with a projecting portion so that said cylindrical portion (39) pushes said tabs (21) against said outer annular rim (9) through said projecting portion (43).

To be sure, a device of this type affords, on the one hand, the economic advantages of the plastics type devices having tabs and, on the other hand, affords geometrical improvements which allow it better to absorb the variations in the glass bottles it is wanted to stop.

On the one hand, each tab has two first protuberances on the inner surface thereof. Where it is desired to contact an irregular surface, it is always better to have a larger amount of points of contact with a small contact surface than a smaller amount of points of contact with a large contact surface. This is due to the fact that in the case of large surfaces, the contact is finally made on small areas of the large surface, with the rest of the large surface remaining in cantilever and, therefore, unused. If, with a view to avoiding this drawback, the large surface is designed in a soft material, so that it deforms and becomes adapted to the irregular surface, there is the risk that such contact subsequently may become loose. Therefore, the arrangement of two first protuberances, with small contact points, for each tab instead of one single first protuberance, with a larger point of contact, represents an improvement for adaptation to the variations present in the bottles to be stopped.

Each tab is provided, also, with a projecting portion on the opposite side, positioned between the two first protuberances. When the sleeve member is placed over the tabs, the sleeve member contacts these projecting portions on which it exerts a pressure causing the tabs to close around the outer annular rim. This geometry causes the tab to withstand a bending force, where the distance between the point of application of the force, that is, the apex of the projecting portion and the point of application of the reaction, that is the first protuberances is approximately equal to half the width of the tab, thereby generating a "leaf spring effect" in the transverse direction of the tab which is distributed over the entire length of the first protuberances and of the projecting portion. This way of working of the tab, with this "leaf spring effect" in the transverse direction of the tab is also novel. In this way a tension is obtained in the device around the entire outer perimeter of the outer annular rim exerting a more or less constant force on the upper edge of the neck, where a resilient seal improving the tightness of the closure is usually placed.

The projecting portion is preferably substantially centered between both lateral surfaces and may be a more or less fine partition wall projecting perpendicularly from outer surface of the tab, as will be described hereinafter, or it may be a swelling of the outer surface itself, or at least of a part thereof. This swelling forms a convex surface which, preferably, starts from an intermediate point of the outer surface and extends away from the outer edge region and from the longitudinal axis.

The swelling of the outer surface preferably corresponds to a recessed portion on the inner surface. The swelling is advantageously formed as a cylindrical surface or a conical surface. This geometry improves the bending behavior of the tab.

The projecting portion preferably extends to the lower surface of the tab.

Another preferred embodiment of the invention is obtained when the first protuberances are substantially walls of variable thickness, measured in an angular direction relative to the longitudinal axis, with a first base, a first upper edge, a first lower lateral end and a first upper lateral end, where the first protuberances extend from the lower surface to an intermediate point of the inner surface and where the thickness increases from a minimum value at the first lower lateral end to a maximum value at the first upper lateral end. It is particularly advantageous when the distance between the first base and the first upper edge is increasing, reaching a maximum value at a point close to the first lower lateral end.

An additional preferred embodiment is obtained when the projecting portion forms a second protuberance which projects from the outer surface and which is generally equidistant from both lateral surfaces.

A further preferred embodiment is obtained when the first protuberances are elongate walls, having the shape of an elongated triangle, which guarantees contact with the outer annular rim in a plurality of cases in which very disparate relative positions between both elements occur: outer annular rim farther from, closer to, higher than or lower than the ideal theoretical positions. The sloping wall of the triangle, which is longer than the variations foreseeable in the glass bottle, ensures that contact will be made between the outer annular rim and the first protuberances.

Advantageously, the first protuberances are deformed partially in the contact area with the outer annular rim, to ensure that contact is made with all the first protuberances along the outer perimeter of the outer annular rim and anchorage of the device on the bottle neck is ensured. Since these first protuberances have a relatively small deformation section, materials having a relatively high hardness may be selected for the protuberances (which materials will usually coincide with the materials of the entire main body), without this meaning that the force of assembly of the sleeve member on the tabs has to reach excessive values.

The second protuberance is preferably also an elongate wall, which improves the distribution of stress by the above mentioned "leaf spring effect" and the elongate wall is preferably triangular likewise. This allows the force applied on the first protuberances when the sleeve member is slid over the tabs during the assembly operation to be applied progressively, which causes the entire device to be centered on the outer annular rim during the assembly process.

BRIEF DESCRIPTION OF THE DRAWINGS

Further advantages and features of the invention will be appreciated form the following description n which there is related preferred embodiments of the invention without any limiting nature, with reference to the accompanying drawings.

FIG. 1 is a bottom plan view of a main body.

FIG. 2 is a side elevation view of the main body of FIG. 1.

FIG. 3 is a top plan view of the main body of FIG. 1.

FIG. 12 is a side elevation view of a further variant of the main body.

FIG. 13 is cross section view of yet a further variant of the main body.

FIGS. 18 to 21 are cross section views showing an assembly sequence of a device on a bottle.

Figure 4:
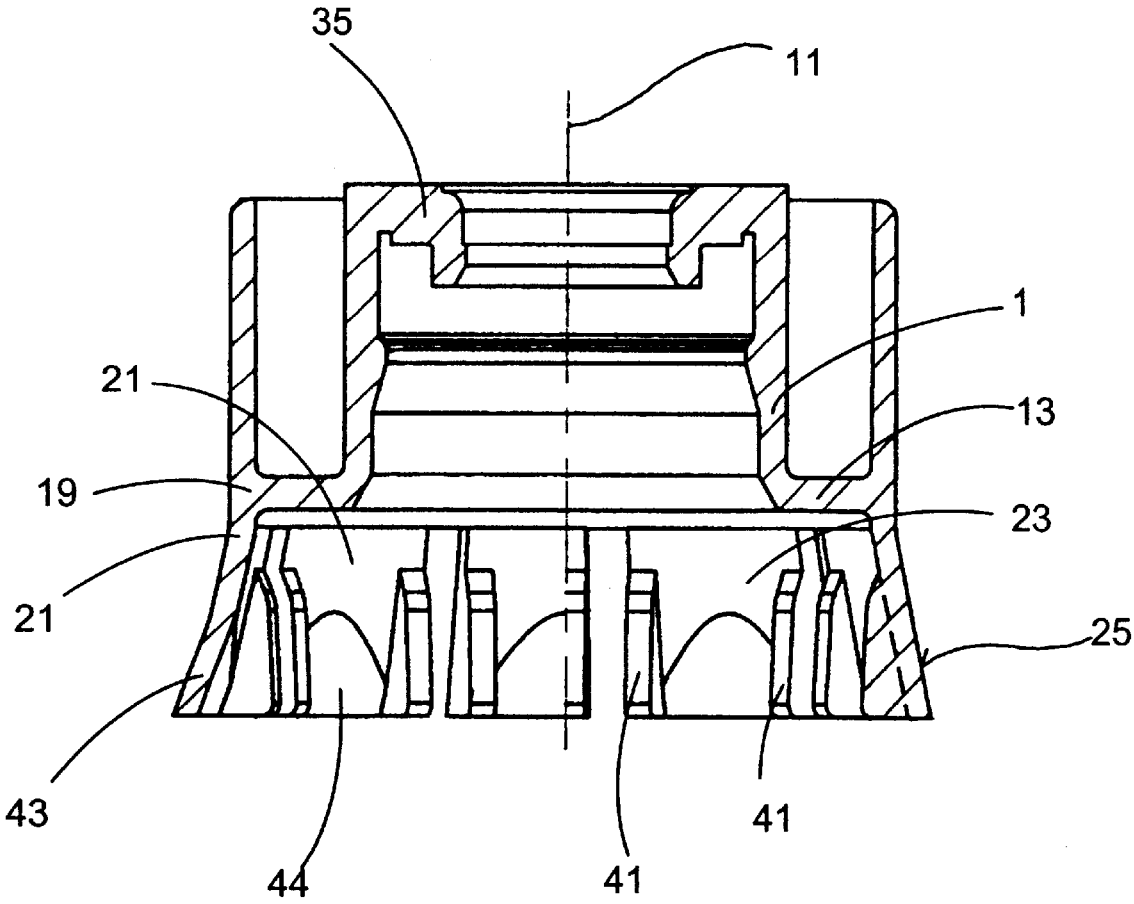
FIG. 4 is a cross section view on the line IV—IV of the main body of FIG. 1.
Figure 5:
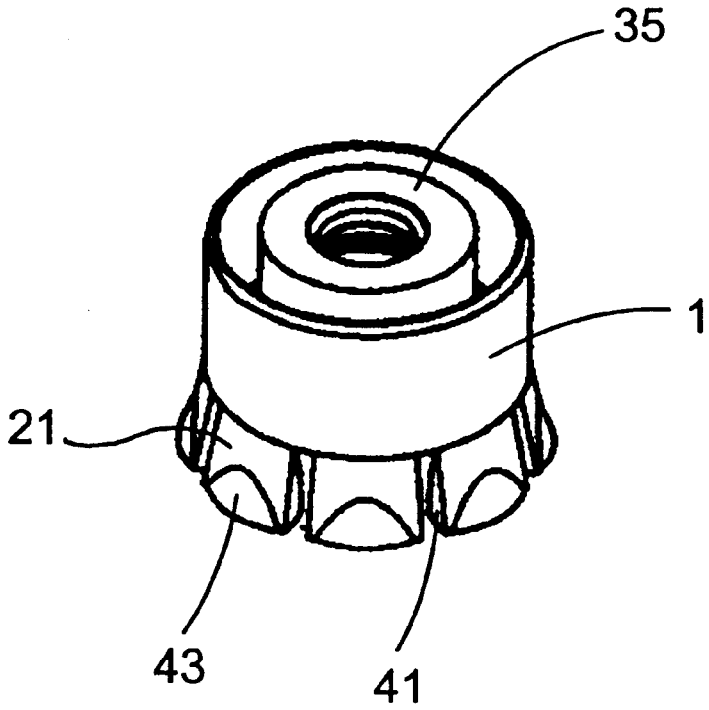
FIG. 5 is a perspective view of the main body of FIG. 1.

A device for stopping bottles according to the invention comprises a main body 1 and a sleeve member 3. The bottle has a neck 5 with an upper edge 7, where it is provided with an outer annular rim 9. The neck 5 is cylindrical with a circular cross section and defines a longitudinal axis 11.

DESCRIPTION OF THE EMBODIMENTS

The main body 1 has an annular portion 13 which, when the device is mounted on the neck 5, is parallel to the upper edge 7 of the neck 5 and the axis of which coincides with the longitudinal axis 11. The annular portion 13 is provided with a lower surface 15 which, when the device is mounted on the neck 5, faces the upper edge 7 of the neck 5, an upper surface 17, opposite to the lower surface 15, and an outer edge region 19, from which tabs 21 extend on the lower surface 15 side, distributed uniformly around the outer perimeter of the annular portion 13. The tabs 21 have an inner surface 23, an outer surface 25, two lateral surfaces 27, a lower surface 29 and a connection region 31, whereby the tabs 21 are attached to the annular portion 13. When the device is in the mounted position, the inner surface 23 faces and is adjacent the neck 5 of the bottle.

The main body 1 may additionally be provided with further elements which will fulfil other functions outside the scope of the invention. In the examples shown in the Figures, the main body 21 has an attachment region 35 which serves for the attachment of a liquid spray pump 37.

Figure 15:
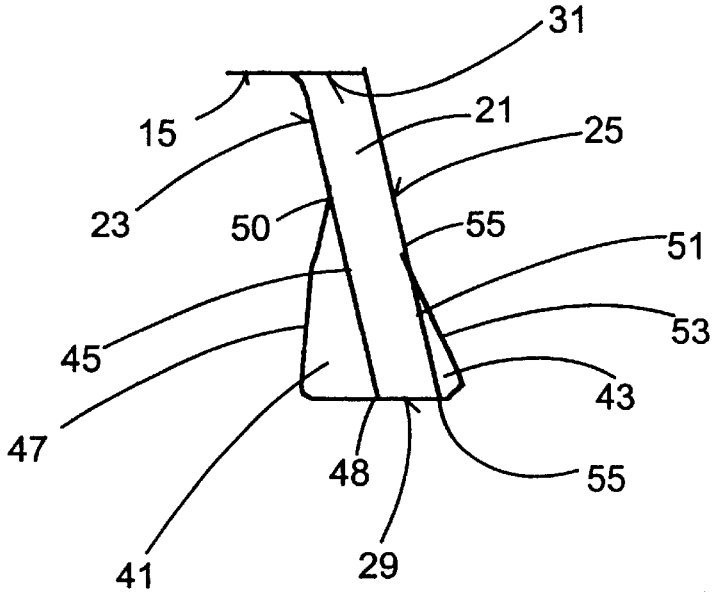
FIG. 15 is a view of a lateral profile of a tab having a second protuberance.

Each tab 21 has two first projections or protuberances 41, each of which is adjacent one of the lateral surfaces 27. FIG. 15 is a side view of a tab 21, in which there is to be clearly seen a first protuberance 41 disposed on the inner surface 23 of the tab 21, and a second projection or protuberance 43, disposed on the outer surface 25 of the tab 21. The first protuberance 41 is an elongate wall, as may be seen in FIG. 13, and comprises a first base 45, whereby the first protuberance 41 is attached to the tab 21, a first upper edge 47, a first lower lateral end 48, adjacent the lower surface 29 of the tab 21, and an upper lateral end 50, at an intermediate point on the inner surface 23. the first protuberances 41 are substantially parallel to the longitudinal axis 11 when the device is mounted on the bottle.

The second protuberance 43 is situated at the center portion of the outer surface 25 of the tab 21 and extends approximately centered between the two lateral surfaces 27, as shown in FIG. 2. The inner surface 23 has a recessed portion 44 which corresponds with the second protuberance 43.

Figure 6:
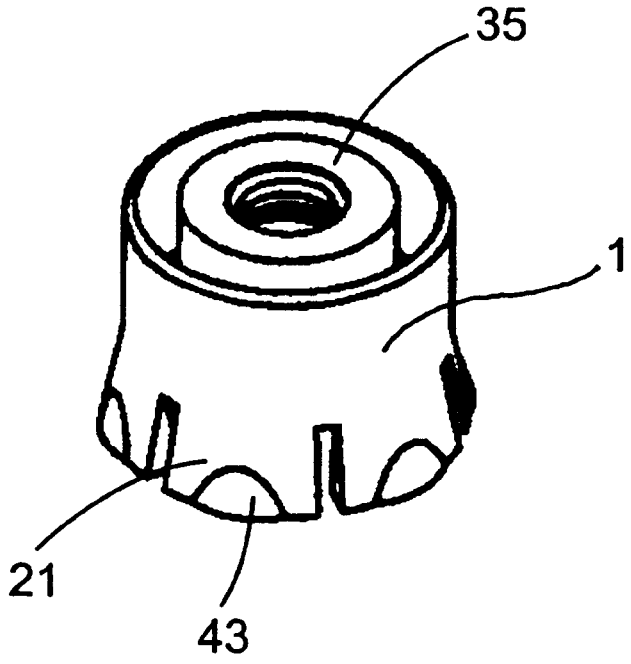
FIG. 6 is a perspective view of a main body similar to that of FIG. 1, but having a different number of tabs.
Figure 14:
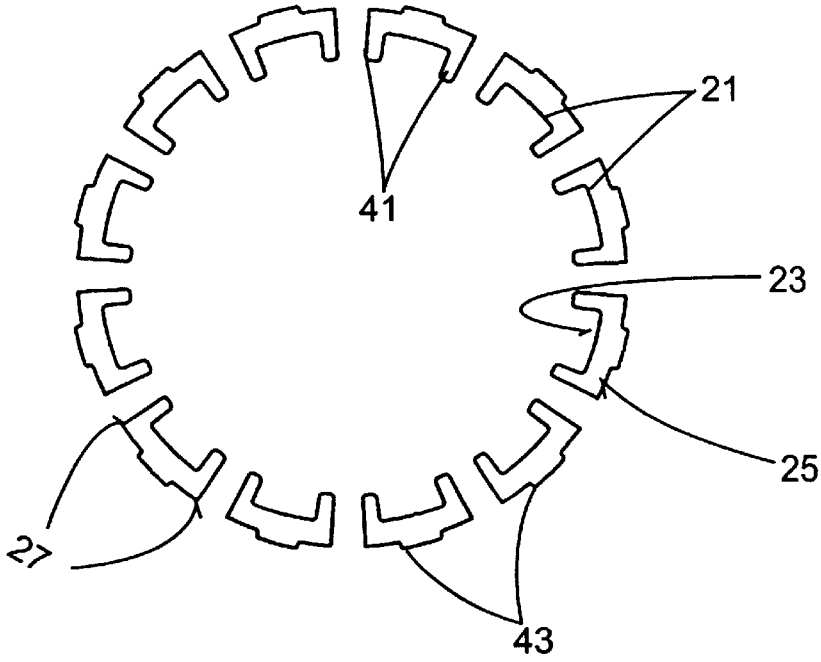
FIG. 14 is a bottom plan view of the tabs of a further variant of the main body.

FIGS. 1 to 5 show a main body 1 having eight tabs 21, nevertheless, it is possible to achieve the object on the invention with other numbers of tabs 21, such as for example six tabs 21, as shown in FIG. 6, twelve tabs, as shown in FIG. 14, etc. It is also possible to provide the main body 1 with an odd number of tabs 21.

Figure 7:
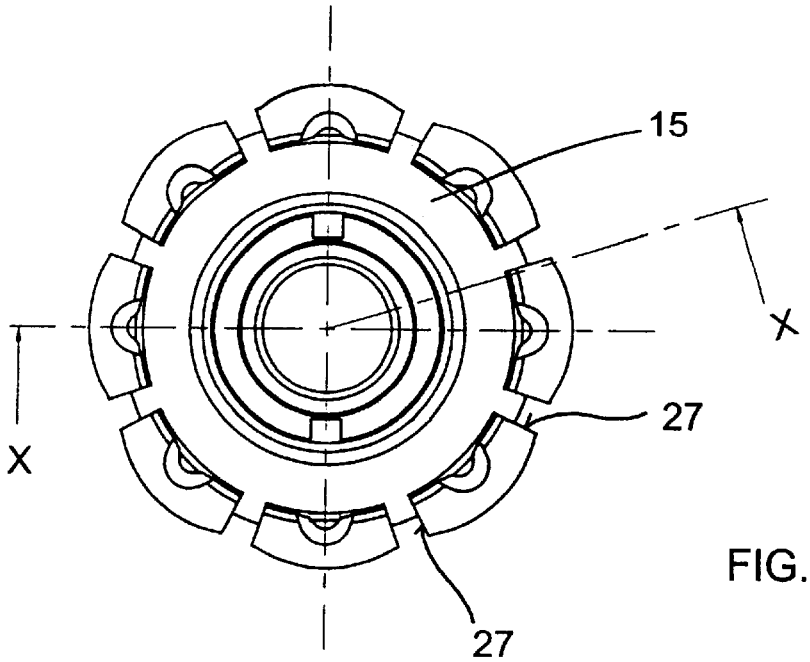
FIG. 7 is a bottom plan view of another main body.
Figure 8:
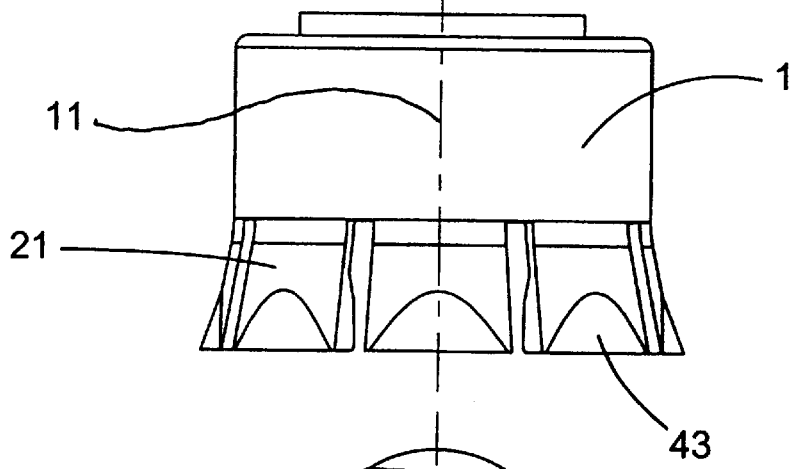
FIG. 8 is a side elevation view of the main body of FIG. 7.
Figure 9:
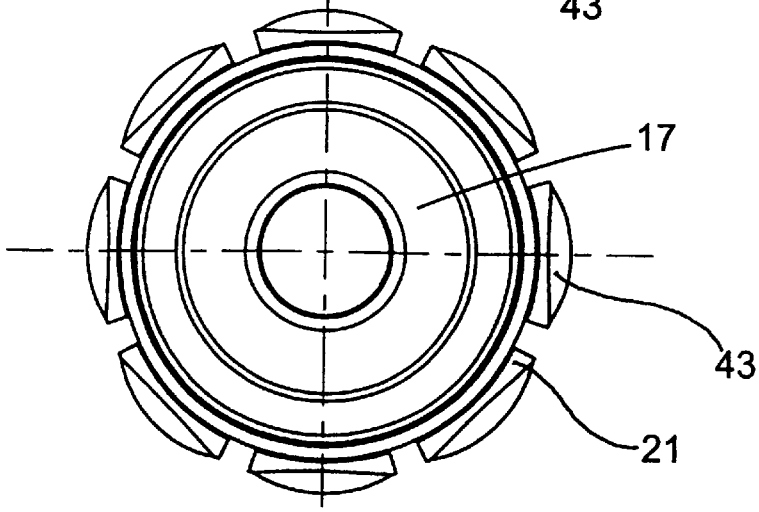
FIG. 9 is a top plan view of the main body of FIG. 7.
Figure 10:
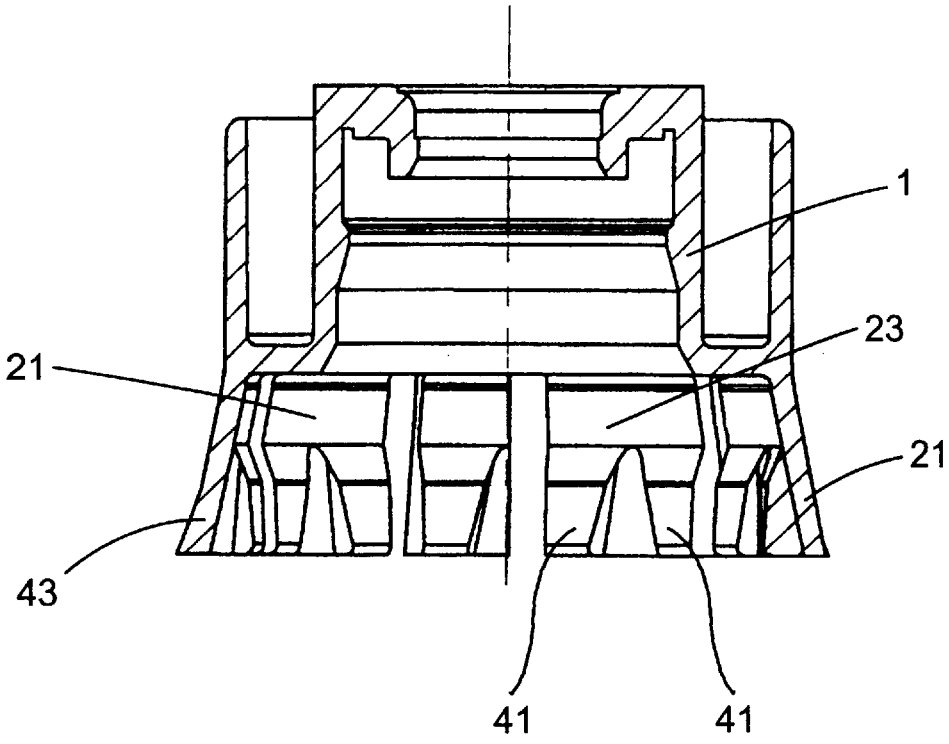
FIG. 10 is a cross section view on the line X—X of the main body of FIG. 7.
Figure 11:
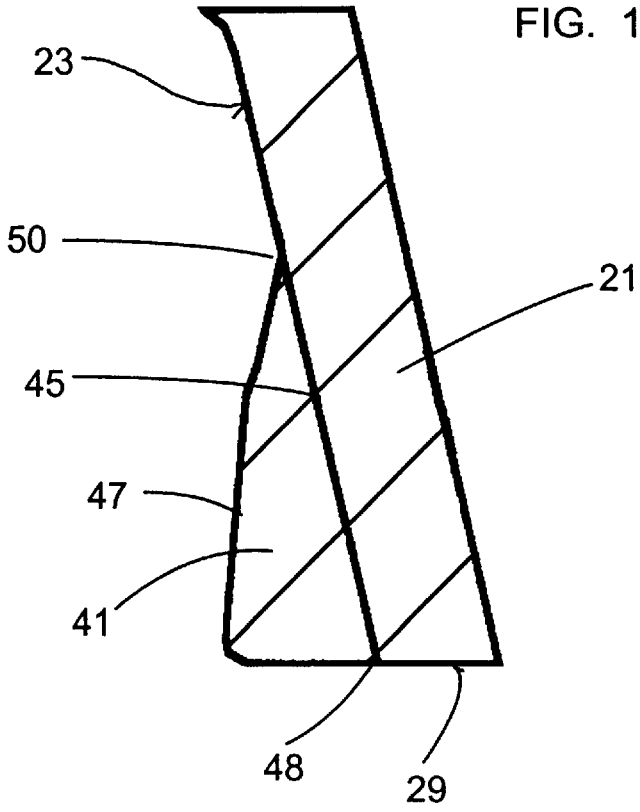
FIG. 11 is an enlarged fragmentary view, of the tab area of the extreme right-hand side of FIG. 10.

FIG. 11 is a side view of a tab 21 where there is clearly to be seen the presence of an alternate embodiment of the first protuberance 41, disposed on the inner surface 23 of the tab 21. This first protuberance 41 is an elongate wall, of variable thickness, measured in the angular direction relative to the longitudinal axis 11, as may be appreciated in FIGS. 7 and 10. The first protuberance 41 comprises a first base 45, whereby the first protuberance 41 is attached to the tab 21, a first upper edge 47, a first lower lateral end 48 and a first upper lateral end 50. the lower lateral end 48 is adjacent the lower surface 29 of the tab 21 and the upper lateral end 50 is at an intermediate point of the inner surface 23. The region of attachment of the first protuberance 41 and the inner surface 23 is rounded, so that the inner surface 23 merges into the lateral surface of the first protuberance 41. The first protuberances 41 are substantially parallel to the longitudinal axis 11 when the device is mounted on the bottle.

FIG. 11 also shows that the cross section of the first protuberance 41 is approximately that of a triangle bearing against the inner surface 23 and having the apex very close to the lower end thereof, in such a way that the distance between the first base 45 and the first upper edge 47 increases to reach a maximum value at a point close to the first lower lateral end 48.

The second protuberance 43 shown in FIGS. 12 and 15 is also an elongate wall and also comprises a second base 51, whereby the second protuberance 43 is attached to the tab 21, a second upper edge 53 and two second lateral ends 55, one of them adjacent the lower surface 29 of the tab 21 and the other at an intermediate point on the outer surface 25. The second protuberances 43 are also substantially parallel to the longitudinal axis 11 when the device is mounted on the bottle.

In FIG. 13 it is seen that each tab 21 has two first protuberances 41, each of which is adjacent one of the lateral surfaces 27. On the other hand, the second protuberance 43 is situated in the center of the outer surface 25 of the tab 21, approximately equidistant between both lateral surfaces 27, as shown in FIG. 12.

The sleeve member 3 comprises a hollow substantially cylindrical portion 39, adapted to slide over the tabs 21. In the mounted position, the hollow substantially cylindrical portion 39 is concentrical with the longitudinal axis 11 and presses the tabs 21 against the outer annular rim 9.

Figure 16:
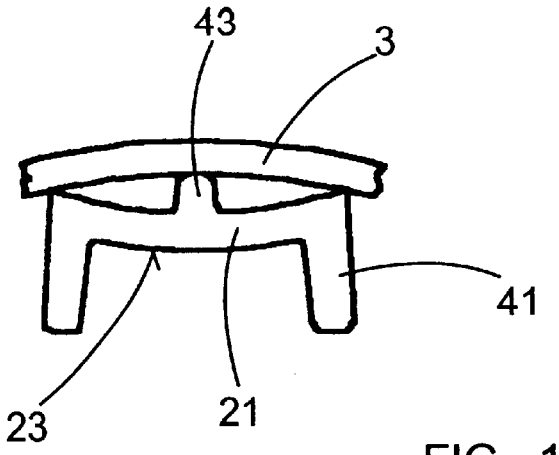
FIG. 16 is a lower plan view of the tab of FIG. 15 under pressure from the sleeve member (shown in part) and the outer annular rim (not shown).
Figure 17:
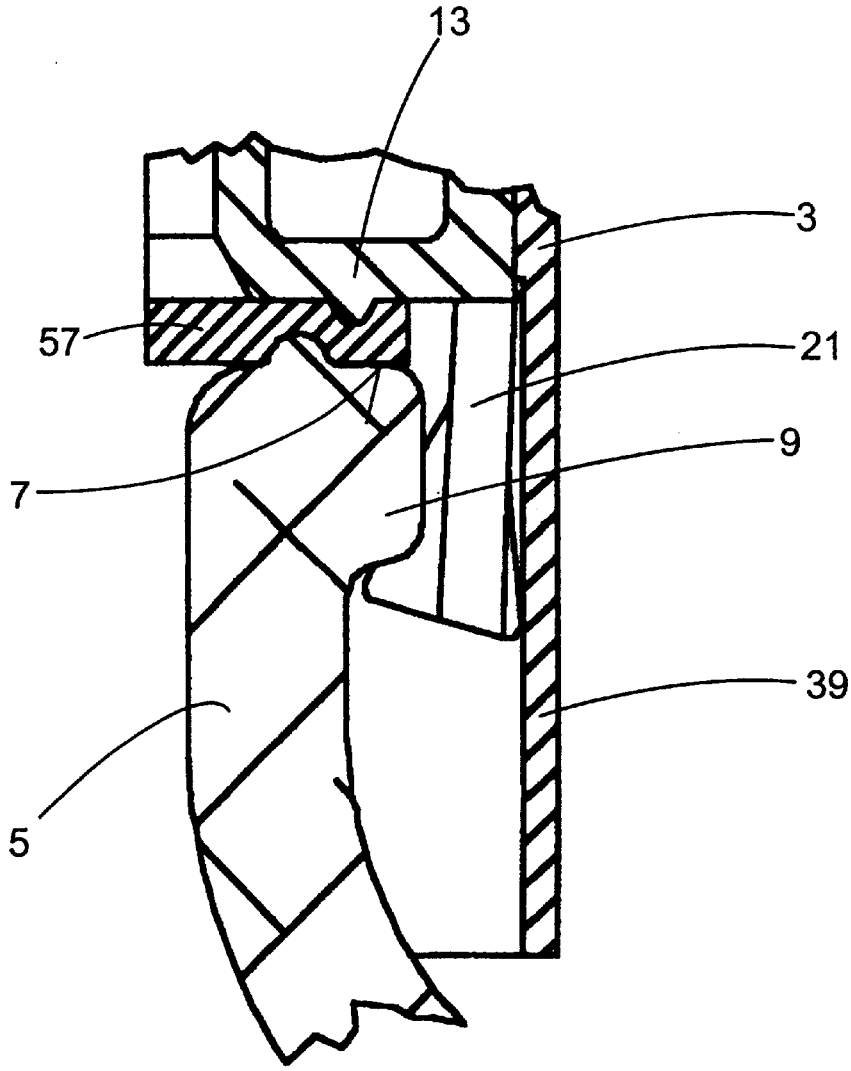
FIG. 17 is a fragmentary cross section view of the device mounted on a bottle.

When the sleeve member 3 is mounted over the tabs 21, the sleeve member 3 pushes the tabs 21 against the outer annular rim 9 through the projecting portions 43 or the second protuberances 43. When the tab 21 abuts the outer annular rim 9, the region of the first upper edge 47 of the first protuberances 41 deforms slightly and becomes curved to partly envelop the lower portion of the outer annular rim 9 and forms hooks which anchor the device to the outer annular rim 9, as may be seen in the fragmentary cross section view of FIG. 17. Additionally, since the first protuberances 41 are pressed against the outer annular rim 9 and, at the same time, the projecting portion 43 or the second protuberance 43 is pressed against the sleeve member 3, the tab 21 is subjected to a bending stress in the transverse direction, tending to curve the tab 21 transversely as shown in FIG. 16 and which affords the advantage that this stressed state is maintained after the device is mounted, which better guarantees the tightness of the closure during the life of the product.

FIGS. 18 to 21 show an assembly sequence of a device for stopping bottles of the invention.

In FIG. 18 a device is seen, with the main body 1 and the sleeve member 3 thereof. The main body 1 is fitted, additionally, with a liquid spray pump 37 and a rubber seal 57. The sleeve member 3 is partly mounted on the main body 1.

FIG. 19 shows the ensemble of FIG. 18 resting on a neck 5 of a bottle having an outer annular rim 9.

FIG. 20 shows that the sleeve member 3 has been lowered further, partly covering the tabs 21. The first upper edges 47 of the first protuberances 41 of the tabs 21 have already started to deform.

Finally, FIG. 21 shows the final state, with the sleeve member 3 completely lowered. A plunger cap 59 has been added to the liquid spray pump 37.

What is claimed is:

1. A device for closing an open neck of a bottle, said device comprising:

a main body having a longitudinal axis, an annular portion perpendicular to the longitudinal axis and having an outer edge region from which tabs extend downwardly, said tabs being provided with an inner surface, an outer surface opposite to said inner surface, lateral surfaces and a lower surface, and a sleeve member with a hollow substantially cylindrical portion to be placed over said tabs, wherein each of said tabs is provided with two first projections extending from said inner surface and which are adjacent said lateral surfaces, and wherein said opposite outer surface is provided with a second projection positioned between the two first projections.

2. The device claim 1, wherein said second projection is substantially centered between the lateral surfaces.

3. The device of claim 1, wherein said inner surface is provided with a recessed portion corresponding with said second projection.

4. The device of claim 1, wherein said second projection forms a convex surface which starts from an intermediate point of said outer surface and extends away from said outer edge region and from said longitudinal axis.

5. The device of claim 1, wherein said second projection extends to said lower surface.

6. The device of claim 4, wherein said convex surface is cylindrical.

7. The device of claim 4, wherein said convex surface is conical.

8. The device of claim 1, wherein said first projections are walls of variable thickness, measured in an angular direction relative to said longitudinal axis, with a first base, a first upper edge, a first lower lateral end and a first upper lateral end, where said first projections extend from said lower surface to an intermediate point of said inner surface, and where said thickness increases from a minimum value at said first lower lateral end to a maximum value at said first upper lateral end.

9. The device of claim 1, wherein said first projections are substantially elongate walls, with a first base, a first upper edge, a first lower lateral end, and a first upper lateral end, said first projections being substantially parallel to said longitudinal axis, and said first projections extending from said lower surface to an intermediate point on said inner surface.

10. The device of claim 9, wherein a distance between said first base and said first upper edge increases, reaching a maximum value at a point close to said first lower lateral end.

11. The device of claim 8, wherein said second projection is substantially equidistant between the two first projections.

12. The device of claim 11, wherein said second projection is a substantially elongate wall, with a second base, a second upper edge and two second lateral ends, said second projection being substantially parallel to said longitudinal axis, and said second projection extending from said lower surface to an intermediate point on said outer surface.

13. The device of claim 12, wherein a distance between said second base and said second upper edge increases, reaching a maximum value at a point close to said second lateral end adjacent said lower surface.

14. The device of claim 1, wherein said first projections are deformable.

* * * * *